US007347065B1

(12) United States Patent
DeGolyer

(10) Patent No.: US 7,347,065 B1
(45) Date of Patent: Mar. 25, 2008

(54) CLASP ASSEMBLY FOR JEWELRY

(76) Inventor: BarbaraJayne DeGolyer, 1909 Spanish Trail, Delray Beach, FL (US) 33483-4960

( * ) Notice: Subject to any disclaimer, the term of this patent is extended or adjusted under 35 U.S.C. 154(b) by 0 days.

(21) Appl. No.: 11/251,501

(22) Filed: Oct. 18, 2005

(51) Int. Cl.
*A44C 5/00* (2006.01)
*A44C 7/00* (2006.01)
*A44C 19/00* (2006.01)

(52) U.S. Cl. ..... 63/7; 63/3.1; 63/15; 63/12; 63/3

(58) Field of Classification Search ..... 63/7, 63/12, 3, 3.1, 15, 15.3, 15.4
See application file for complete search history.

(56) References Cited

U.S. PATENT DOCUMENTS 895,866 A * 8/1908 Kent ..... 63/7
1,047,623 A * 12/1912 Eklund ..... 63/7
2,582,878 A * 1/1952 Metcalf ..... 63/7
3,204,426 A * 9/1965 Armstrong ..... 63/15.5
3,736,770 A * 6/1973 Kelrick ..... 63/15.7
4,292,715 A * 10/1981 Huddon ..... 24/705
4,694,664 A * 9/1987 Elsener ..... 63/12
4,815,180 A * 3/1989 Elsener ..... 24/616
4,879,883 A * 11/1989 Bruner ..... 63/15.7
5,412,956 A * 5/1995 Levy ..... 63/15.65
5,816,073 A * 10/1998 Bardisbanyan ..... 63/12
6,125,657 A * 10/2000 Esposito ..... 63/12
6,843,072 B1 * 1/2005 Lau ..... 63/12
7,107,789 B1 * 9/2006 Bruner ..... 63/15.7

* cited by examiner

*Primary Examiner*—Katherine Mitchell
*Assistant Examiner*—David C Reese
(74) *Attorney, Agent, or Firm*—Albert Bordas, P.A.

(57) ABSTRACT

A clasp assembly for jewelry to be worn as a ring or earring. As a ring, the clasp assembly for jewelry allows individuals to wear rings around finger phalanges, by locking the rings below the knuckles of the fingers without having to slide the rings over knuckles of the fingers. As an earring, the clasp assembly for jewelry allows individuals to wear an earring on various parts of the individual.

1 Claim, 3 Drawing Sheets

Fig 4
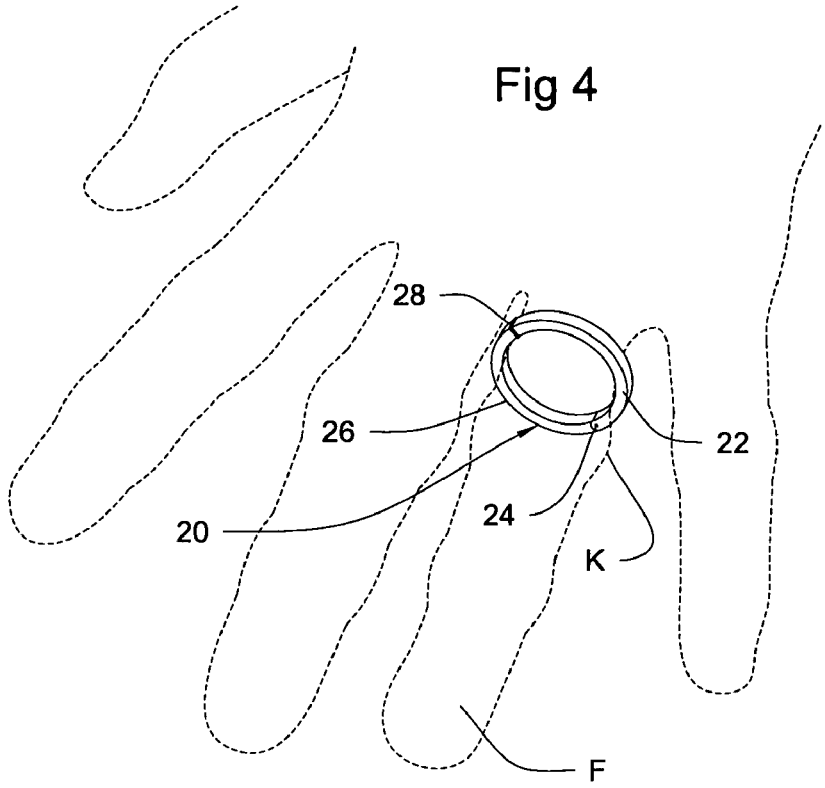
Fig 6
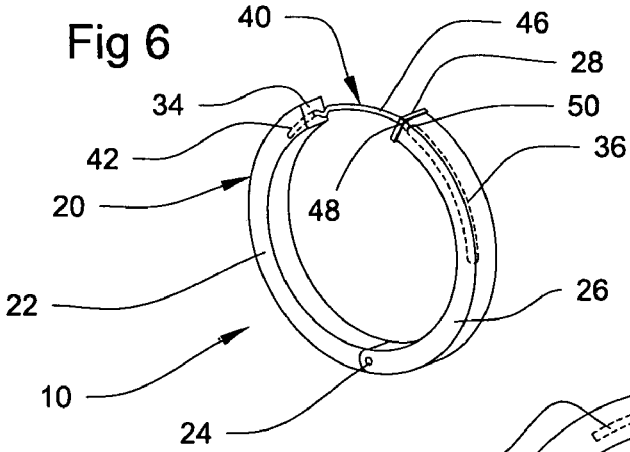
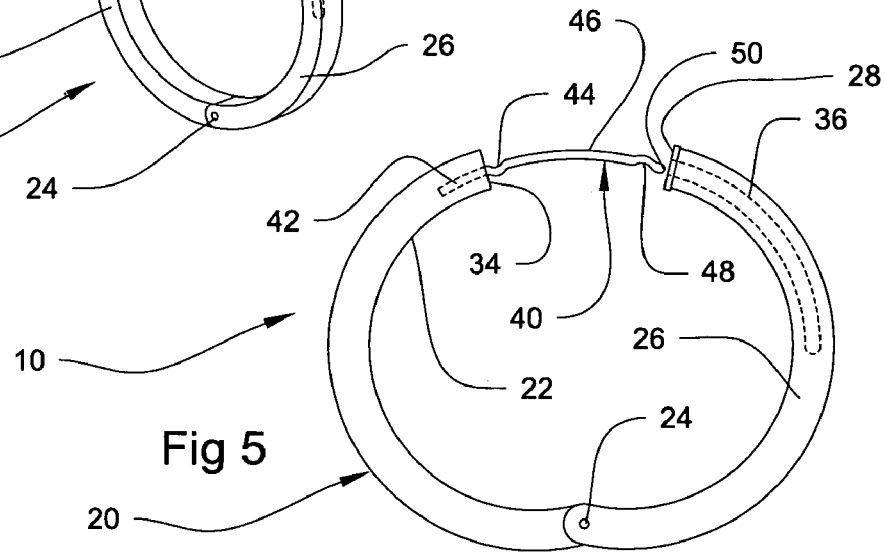
Fig 5

CLASP ASSEMBLY FOR JEWELRY

BACKGROUND OF THE INVENTION

1. Field of the Invention

The present invention relates to jewelry, and more particularly to a clasp assembly for jewelry.

2. Description of the Related Art

Many people suffer from arthritis in the joints of the hand. Arthritis is a problem that causes a wearing away of normal joint surfaces, defined as cartilage wear. Joints are the points where two bones meet each other. These junctions have special linings on the bones to allow motion at the joints. When this special lining, cartilage, is worn away, arthritis is the condition that results.

There are two types of arthritis that commonly affect the fingers and thumb. These are osteoarthritis and rheumatoid arthritis. Osteoarthritis, also called degenerative joint disease and wear-and-tear arthritis, is the most common type of arthritis. In this condition, the normal cartilage is steadily worn away, exposing bare bone at the joints. The most commonly affected joints in the fingers are the knuckles of the mid-finger and fingertip, the PIP and DIP joints, and the joint at the base of the thumb. Symptoms of hand arthritis include: joint pain, swelling, stiffness, and loss of motion.

Individuals with osteoarthritis often develop lumps or nodules around the knuckles of the fingers. These lumps are called Heberden's nodes, when around the more distant knuckle, or Bouchard's nodes, when around the closer knuckle, and actually consist of bone spurs, or osteophytes, around the joints. These knuckles often become enlarged, swollen, and stiff.

Rheumatoid arthritis causes a different type of joint destruction. Rheumatoid arthritis is a systemic disease that can cause a number of problems. Among these, rheumatoid arthritis can cause inflammation of the lining of joints. The most commonly affected joints in the hand are the knuckles at the base of the fingers, the MCP joints.

Individuals with rheumatoid arthritis often have the aforementioned symptoms, but can also have more complex deformities of the hands. These include deformities such as a "Boutonniere" or "swan neck" deformity. The fingers may begin to shift from their normal position, and drift away from the thumb.

Presently, it is impossible for some individuals to wear rings on fingers as jewelry. For those individuals that are able to wear rings on fingers, the selection of fingers may be limited and is often discomforting to place on and remove since the rings are a fixed size and must slide over knuckles of the fingers.

There are no clasp assemblies for jewelry to the best of applicant's knowledge that allow individuals with arthritis, or otherwise large and/or swollen finger knuckles or joints to wear rings around phalanges by clasping the rings below the knuckles without having to slide over the knuckles.

SUMMARY OF THE INVENTION

The instant invention is a jewelry clasp assembly, comprising a band assembly having first and second band members hingely connected by a pin. The first band member has a face and the second band member has a locking plate. The locking plate has first and second edges. A bridge has an elongated torso and first and second ends. The first end extends from the face. The elongated torso has a first notch that is a first predetermined distance from the first end without reaching the second end. First locking means lock the bridge to the second band in a first locked position, wherein the bridge has a first spring tension and the first notch snaps into the locking plate. The first spring tension biases the first notch against the first edge of the locking plate. The band assembly is placed onto a phalange as jewelry below a knuckle without having to slide the band assembly over the knuckle and is locked in the first locked position. The phalange is of a finger or toe.

The elongated torso has a second notch. The second notch is a second predetermined distance from the first notch without reaching the second end. Second locking means lock the bridge to the second band in a second locked position, wherein the bridge has second spring tension and the second notch snaps into the locking plate. The second spring tension biases the second notch against the second edge of the locking plate. The first notch is opposite in direction to the second notch. The bridge has curvature. The face and the locking plate are separated a third predetermined distance by the bridge when in the second locked position, and the bridge pierces a body part as jewelry. The body part is a nose, eyebrow, nipple, ear, tongue, mouth lip, vaginal lip, and/or penis.

It is therefore one of the main objects of the present invention to provide a clasp assembly for jewelry that allows individuals with to wear rings around phalanges, by locking the rings below the knuckles without having to slide the rings over the knuckles.

It is another object of this invention to provide a clasp assembly for jewelry that allows individuals with arthritis, or otherwise large and/or swollen finger knuckles or joints to wear rings around finger phalanges, by locking the rings below the knuckles of the fingers without having to slide over knuckles of the fingers.

It is yet another object of this invention to provide a clasp assembly for jewelry having at least one lock position.

It is still another object of this invention to provide a clasp assembly for jewelry that allows the jewelry to be worn as an earring.

It is still another object of the present invention to provide a clasp assembly for jewelry that is secure.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 4 is a representation of the instant invention in the first locked position being worn as a ring.

FIG. 5 represents a second isometric view of the instant invention in an unlocked position.

FIG. 6 illustrates an isometric view of the instant invention in a second locked position.

DETAILED DESCRIPTION OF THE PREFERRED EMBODIMENT

Figure 1:
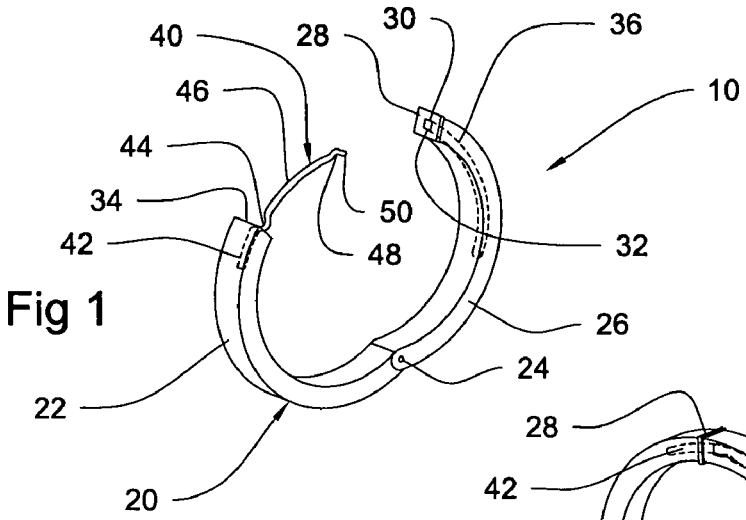
FIG. 1 represents an isometric view of the instant invention in an unlocked position.

Referring now to the drawings, where the present invention is generally referred to with numeral 10, it can be observed that it basically includes band assembly 20 and bridge 40.

As seen in FIG. 1, band assembly 20 comprises band members 22 and 26 hingely connected by pin 24. Extending from band member 22 is bridge 40 having elongated torso 46 defined from end 42 that is fixedly secure within band member 22, and end 50. Bridge 40 further comprises notch 44 adjacent to face 34 of band member 22, and notch 48 adjacent to end 50. Mounted onto the distal end of band member 26 is lock plate 28. Band member 26 also comprises elongated cavity 36 having cooperative characteristics to receive elongated torso 46. Lock plate 28 has edges 30 and 32.

Figure 2:
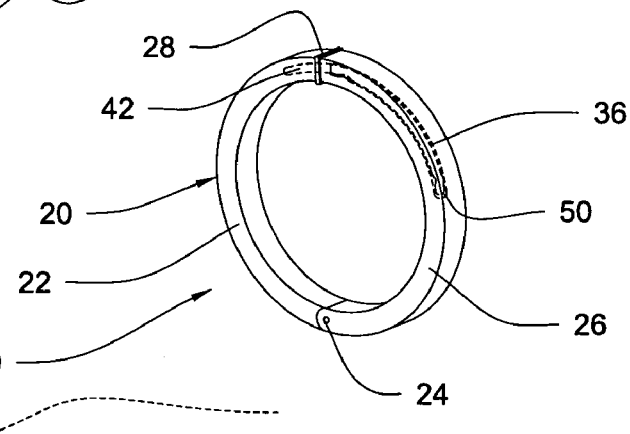
FIG. 2 shows an isometric view of the instant invention in a first locked position.

As seen in FIG. 2, instant invention 10 is in the first locked position. To achieve the illustrated position, end 50 passes through lock plate 28 and into elongated cavity 36 with sufficient force until notch 44 snaps onto edge 30. In the preferred embodiment, bridge 40 has curvature and a first spring tension. The first spring tension keeps notch 44 biased against edge 30, defining a first locking means. It is noted that in the first locked position, face 34 abuts lock plate 28.

Figure 3:
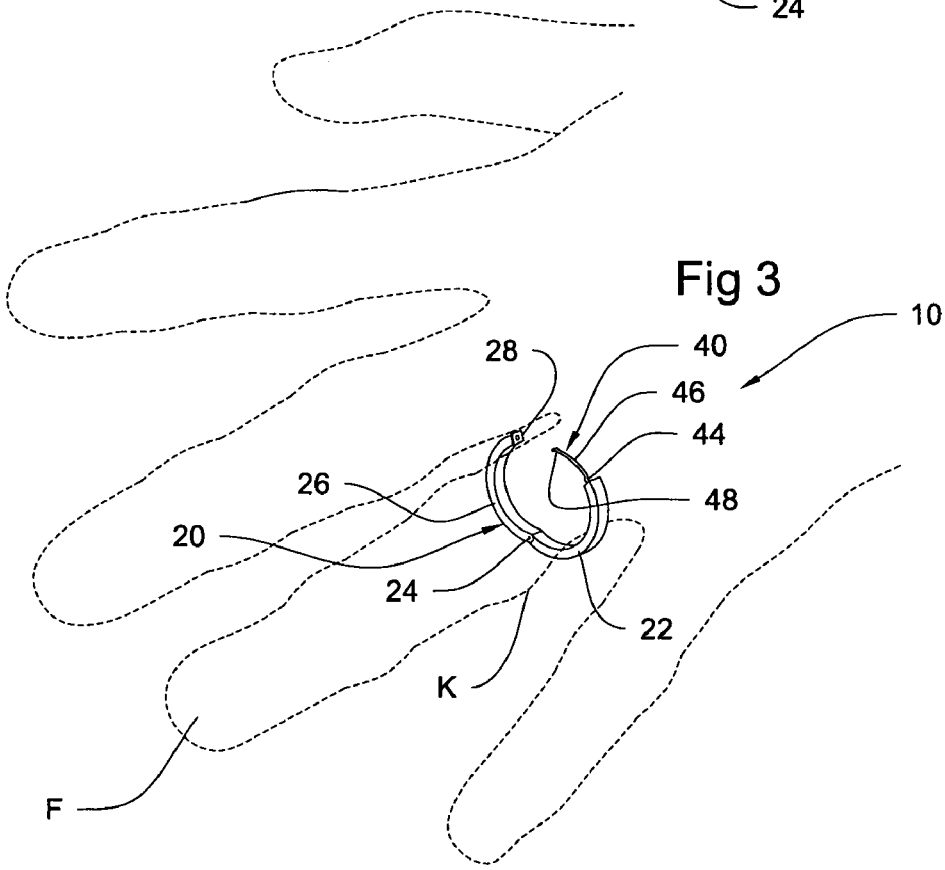
FIG. 3 is a representation of the instant invention presented on a finger to be locked.

As seen in FIG. 3, instant invention 10 is positioned below knuckle K of ring finger F. The individual may now place instant invention 10 in the first locked position, as seen in FIG. 4, and wear it as a ring, without having to slide instant invention 10 over knuckle K of any fingers.

As better seen in FIG. 5, notch 44 is opposite in direction to notch 48.

As seen in FIG. 6, instant invention 10 is in the second locked position. To achieve the illustrated position from the open position illustrated in FIG. 1, end 50 passes through lock plate 28 with sufficient force until notch 48 snaps onto edge 32. In the preferred embodiment, bridge 40 has curvature and a second spring tension. To achieve the illustrated position, the sufficient force overcomes the second spring tension and the second spring tension keeps notch 48 biased against edge 32, defining a second locking means. It is noted that in the second locked position, the distance between face 34 and lock plate 28 is sufficient to accommodate an earlobe.

Figure 7:
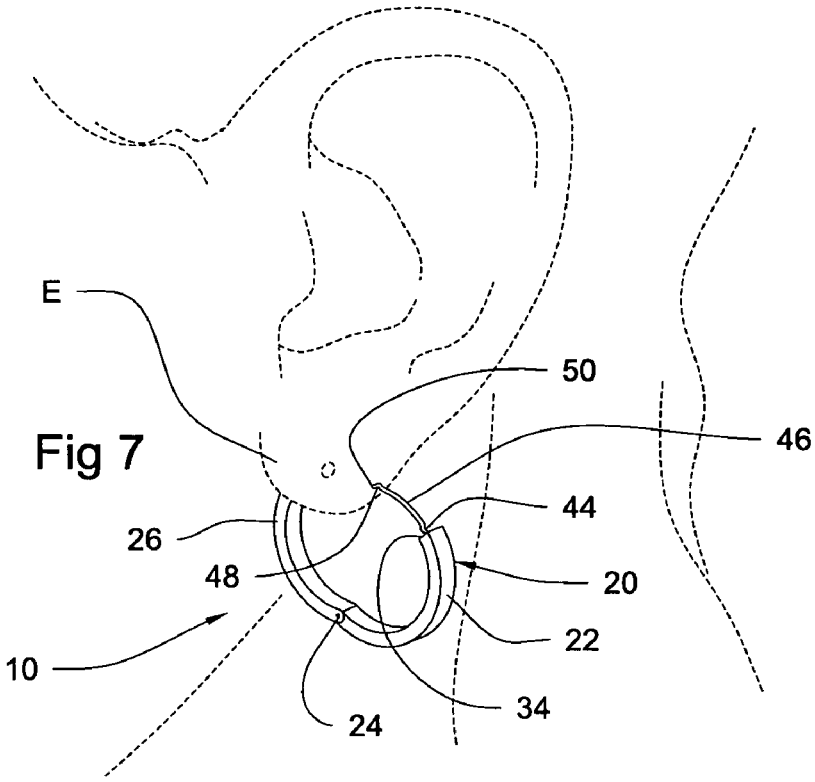
FIG. 7 is a representation of the instant invention presented on an earlobe to be locked.
Figure 8:
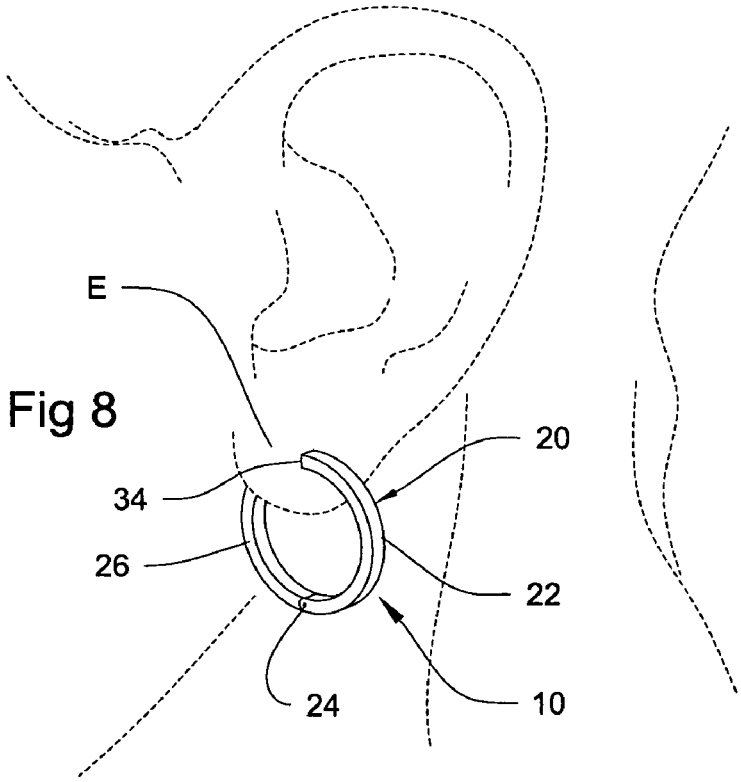
FIG. 8 is a representation of the instant invention in the second locked position being worn as an earring.

As seen in FIG. 7, instant invention 10 is positioned at an earlobe E of the individual. The individual may now place instant invention 10 in the second locked position, as seen in FIG. 8, and wear it as an earring.

It is noted that instant invention 10 may be worn as jewelry on various parts of the individual with either the first or second locked positions. Such various parts of the individual may include, but are not limited to the nose, toe, eyebrow, nipple, the helix and/or tragus of the ear, tongue, mouth lip, vaginal lip, penis, or any other part that may accommodate a ring and/or earring.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A jewelry clasp assembly, comprising:

A) a band assembly having first and second band members hingely connected by a pin, said first band member having a face and said second band member having a locking plate, said locking plate having first and second edges;

B) a bridge comprising a single prong having an elongated torso and first and second ends, said bridge has curvature and said first end permanently attached and extending from said face, said elongated torso having a first notch, said first notch is positioned at said first end, said elongated torso also has a second notch, said second notch is positioned at said second end, and said second notch is inverse to said first notch, whereby said first notch is convex in form and said second notch is concave in form; and C) first locking means to lock said bridge to said second band in a first locked position, wherein said bridge has a first spring tension and said first notch snaps into said locking plate, said first spring tension biasing said first notch against said first edge of said locking plate, said band assembly is mounted when in an open position and is then locked in said first locked position, and further comprising second locking means to lock said bridge to said second band in a second locked position, wherein said bridge has second spring tension and said second notch snaps into said locking plate, said second spring tension biasing said second notch against said second edge of said locking plate, and said face and said locking plate are separated a predetermined distance by said bridge when in said second locked position, and said bridge is used for piercing.

* * * * *